US005118250A

United States Patent [19]

Sagnital et al.

[11] Patent Number: 5,118,250

[45] Date of Patent: Jun. 2, 1992

[54] COMPRESSED AIR MOTOR WITH REACTION PROPULSIVE DISK

[76] Inventors: Georges Sagnital, 10 Rue de la Convention, 42100 Saint Etienne, France; Jacques Chauquet, Belle Cote, 74160 Ayse, France

[21] Appl. No.: 333,626

[22] PCT Filed: Jun. 17, 1988

[86] PCT No.: PCT/FR88/00323

§ 371 Date: Apr. 17, 1989

§ 102(e) Date: Apr. 17, 1989

[87] PCT Pub. No.: WO88/10358

PCT Pub. Date: Dec. 29, 1988

[30] Foreign Application Priority Data

Jun. 17, 1987 [FR] France ..... 87 08890

[51] Int. Cl.[5] ..... F01D 1/32

[52] U.S. Cl. ..... 415/80; 415/202; 415/216.1

[58] Field of Search ..... 415/80, 182.1, 202, 415/203, 904, 216.1, 25, 63, 60, 92; 416/20 R, 223 B; 239/240

[56] References Cited

U.S. PATENT DOCUMENTS

| | | | |
|---|---|---|---|
| 1,161,140 | 11/1915 | Lazarides | 415/81 |
| 3,707,336 | 12/1972 | Theis, Jr. et al. | 415/904 X |
| 3,708,241 | 1/1973 | Theis, Jr. et al. | 415/80 |
| 3,748,054 | 7/1973 | Eskeli | 415/80 |
| 3,945,757 | 3/1976 | Cummens | 415/80 |
| 4,178,125 | 12/1979 | Dauvergne | 416/20 R X |

FOREIGN PATENT DOCUMENTS

| | | | |
|---|---|---|---|
| 2442755 | 5/1975 | Fed. Rep. of Germany | 415/80 |
| 78855 | 6/1960 | France | 415/80 |
| 161928 | 5/1933 | Switzerland | 415/80 |

*Primary Examiner*—Edward K. Look
*Assistant Examiner*—James A. Larson
*Attorney, Agent, or Firm*—Eckert Seamans Cherin & Mellott

[57] ABSTRACT

A fluid motor includes a rotatable shaft and at least one disk attached to the shaft. An axial groove on the surface of the shaft forms a channel for communicating pressurized fluid into a receiving chamber in the disk. At least one outlet channel extends from the receiving chamber to a periphery of the disk. A part of the outlet channel defines a reactive channel across all or part of the width of the disk. Fluid from the receiving chamber is exhausted through the outlet channel to a chamber in an exhaust cage which surrounds the disk.

6 Claims, 4 Drawing Sheets

COMPRESSED AIR MOTOR WITH REACTION PROPULSIVE DISK

BACKGROUND OF THE INVENTION

The invention relates to the field of high speed compressed air motors, and in particular, compressed air motors for tools requiring rotational speeds of several tens of thousands of revolutions per minute.

It is an object of the invention to provide a compressed air motor capable of operating at very high rotational speed.

It is another object of the invention to provide a compressed air motor which can be easily manufactured and quickly assembled.

It is a further object of the invention to provide a compressed air motor which is inexpensive, lightweight, and compact.

It is still another object of the invention to provide a compressed air motor which does not require coupling and attachment components.

It is still another object of the invention to provide a compressed air motor which is highly reliable in operation.

A compressed air motor according to the invention comprises a motor shaft rotatably supported in bearings. At least one propeller disk having a central bore is fixed to the motor shaft. The at least one propeller disk defines a chamber on one side for receiving fluid under pressure. The disk further defines at least one exhaust channel extending from the chamber to the external periphery of the disk. High pressure air enters the chamber through the bore of the disk, and is exhausted as at least one air jet through the at least one exhaust channel. The compressed air motor is particularly suited for deburring and grinding tools.

Figure 1:
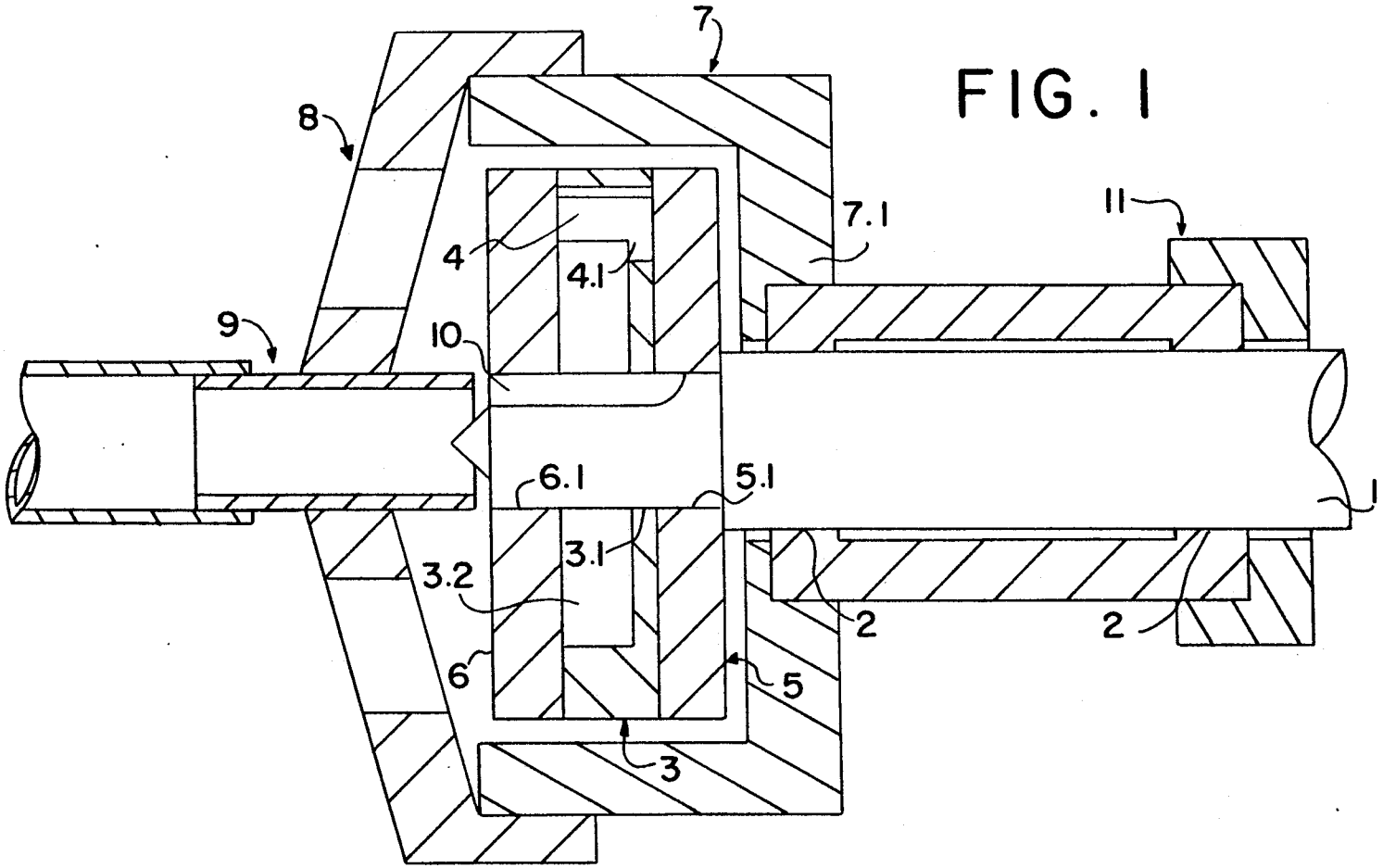
FIG. 1 is a longitudinal cross-section of a compressed air motor according to the invention.
Figure 2:
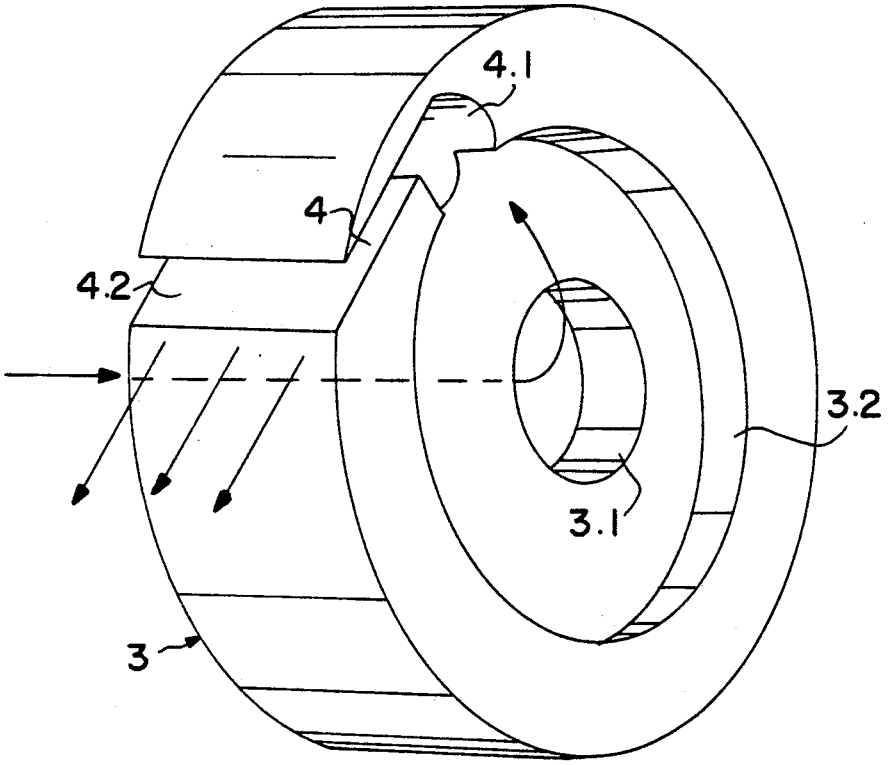
FIG. 2 is a large scale perspective view of a propeller disk of the compressed air motor, showing details of the fluid receiver.
Figure 3:
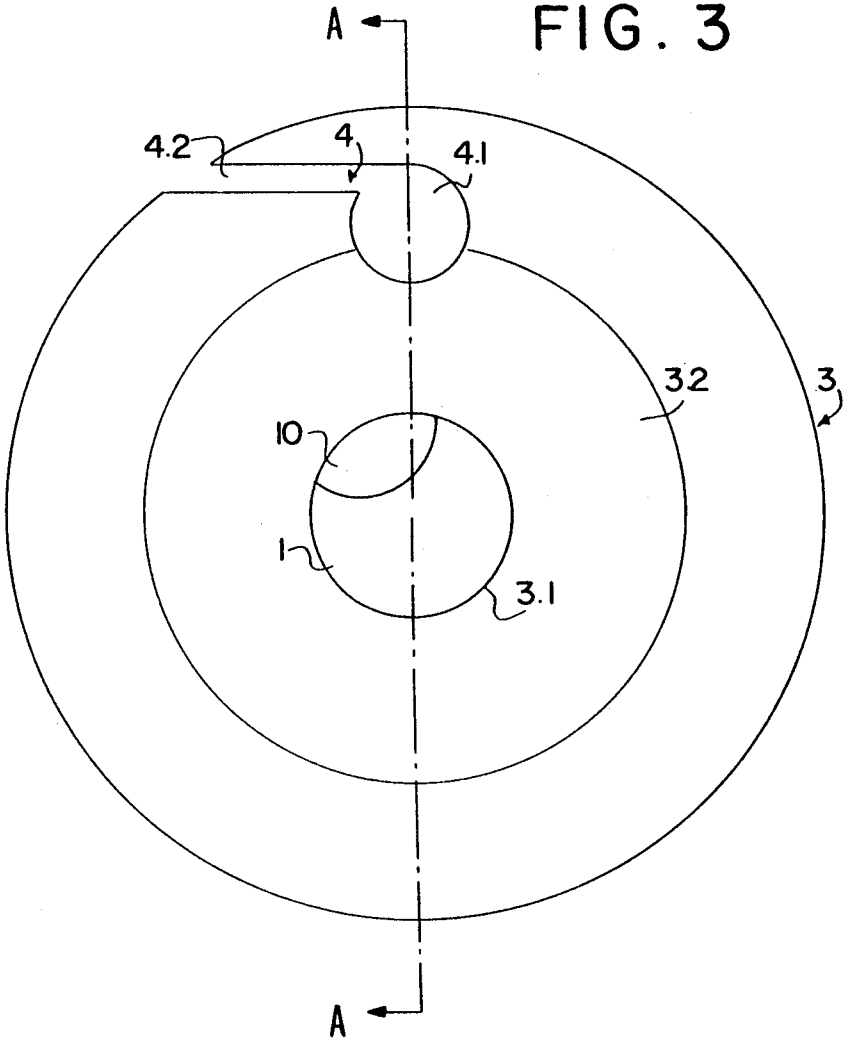
FIG. 3 is a front view of the propeller disk.
Figure 4:
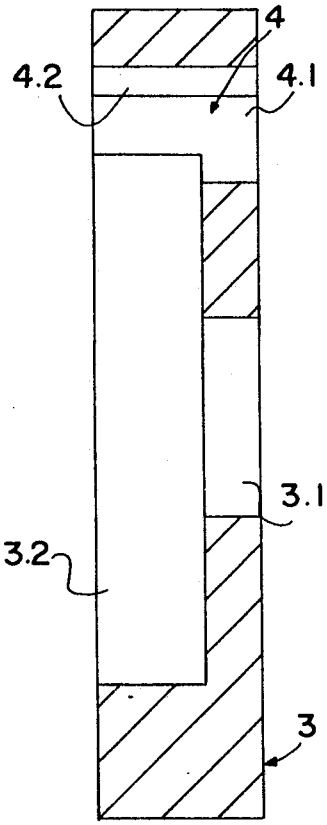
FIG. 4 is a side cross-section view taken along the line A-A of FIG. 3.
Figure 5:
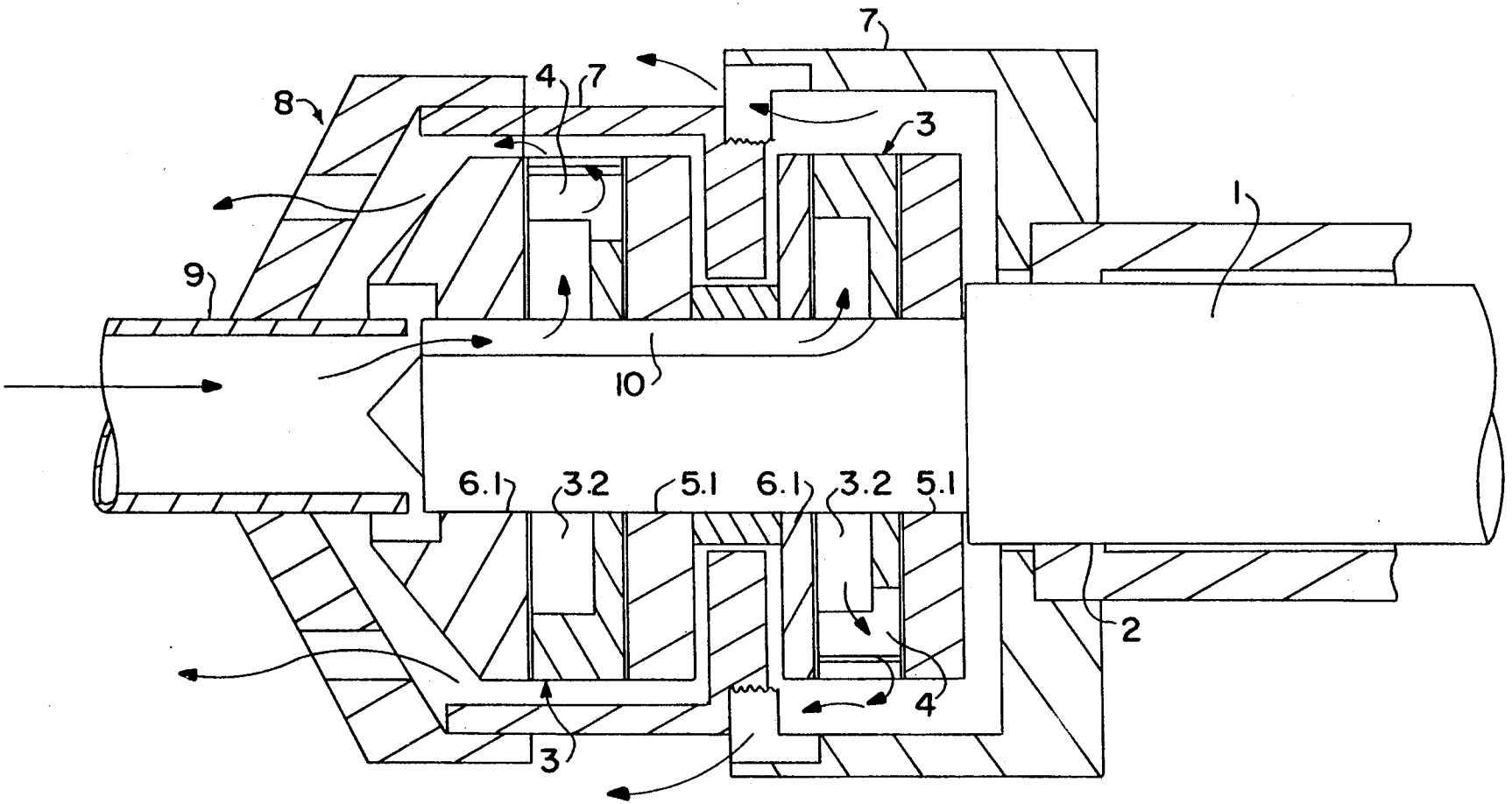
FIG. 5 is a longitudinal cross-section view of the compressed air motor having a plurality of exhaust cages each taking a disk according to the invention.

The advantages of the invention will become more apparent from the following description when considered in conjunction with the drawings.

DETAILED DESCRIPTION OF THE PREFERRED EMBODIMENTS

The pneumatic motor is made up of a very high speed rotary shaft (1) running in two bearings (2) and turned under the effect of at least one jet of air under pressure with high output coming out of at least one opening or exhaust opening radially arranged at any angle on at least one propeller disk (3) integral to the motor shaft, the said opening breaking through the external diameter of the said propeller disk. More precisely, the pneumatic motor is provided with one or several receiver cages with one or several propeller disks turned by at least one injection of fluid either liquid or gas, under pressure.

The motor comprises one propeller disk (3) provided with a central bore (3.1) so as to be mounted onto the motor shaft. The disk comprises on one side, a chamber (3.2) making up a receiver for fluid under pressure. On the periphery of the propeller disk and in its thickness, there are one or several exhaust channels (4) starting at one end (4.1) whilst communicating with the receiver and breaking through at the other end (4.2) by making up a reactive channel on all or part of the width of the propeller disk and on the external periphery of the latter by projecting the fluid into the internal chamber of the exhaust cage. The shape and profile of the exhaust and reactive channel(s) are made so as to be the most suitable for practical construction and in order to guide and orientate the fluid.

The propeller disk is mounted and fixed onto the shaft by any suitable means, particularly by bonding. Front rear flanges (5–6) arranged either side of the propeller disk are provided to laterally seal the receiver of the disk and the exhaust channel(s) of the fluid whilst leaving the reactive channel to be free. These flanges, made of any suitable materials and of desired thickness, are build up and fixed onto the side faces of the disk and more advantageously by bonding. They are also fixed by bonding through their bore (5.1–6.1) on the motor shaft.

The assembly thus comprised is mounted so as to rotated in the exhaust cage (7). The latter is in the shape of a cylindrical sleeve with a wall forming the bottom (7.1) mounted in a fixed position of the bearings (2).

An exhaust grid (8) is build up and fixed onto the external or internal periphery of the sleeve part of the receiver cage of the propeller disk. This grid has an opening arranged its central part for the introduction of a fluid injection nozzle (9) mounted at the end of a fluid supply pipe. The center line of the nozzle is opposite the end of the motor shaft. The end of the latter is tapered and is partially engaged into the said nozzle in order to avoid the loss of fluid. In order for the fluid to be guided and introduced into the receiver of the propeller disk, a groove (10) is provided on the shaft, the said groove making up the fluid injection channel. In addition, there is a nose or retaining ring 11) provided at the rear of the motor thus designed, the said ring being applied against the bearings.

The operation of the pneumatic motor will now be described. The user delivers a fluid under pressure through the injection nozzle which penetrates through the injection channel made on the motor shaft in the receiver of the propeller disk. The fluid is then radially discharged by the exhaust channel(s) on the propeller disk. The latter is then turned thereby driving the motor shaft to which it is associated. The fluid is projected onto the internal periphery of the exhaust cage then it is discharged through the openings or vents of the exhaust grid.

According to the experiments carried out, such a motor runs at a speed which may be regulated by the intensity of projection of the fluid in order to reach speeds between 25,000 and 150,000 rpm with full reliability.

Without coming away from the framework of the invention, the pneumatic motor may comprise several propeller disks mounted on the shaft thus providing it with many torque possibilities. Through the injection channel on the motor shaft, all the receivers made on each disk, shall be at the same pressure along with the exhaust channels. On the other hand, the exhaust channel is extended in order to form the reactive channel, the latter being made in the form of a hole, slot, key way type groove with a cross-section consistent with the motor torque desired.

The pneumatic motor according to the invention many applications. In particular, this motor is particularly advantageous for tools for deburring and grinding or engraving or drilling.

The advantages of the invention are clearly apparent. The following is emphasized in particular:

The simplicity of the assembly of the motor, avoiding the use of any connecting parts.

The simplicity of the production of the components of the motor reducing its manufacturing cost.

The high reliability of operation.

We claim:

1. A fluid motor comprising a rotatable shaft, and at least one disk attached to the shaft, wherein the shaft defines an axial groove forming a channel on a surface of the shaft for injection of a fluid under pressure and at a high flow rate into a circular recess formed in a side surface of the disk so as to create a chamber for receiving the fluid, the chamber communicating with at least one outlet channel, the at least one outlet channel being formed at a periphery of the disk and having an extremity constituting a reactive channel on at least part of a width of the disk, and projecting the fluid into an internal chamber of an exhaust cage.

2. The fluid motor according to claim 1, further comprising flanges mounted and adhered on lateral surfaces of at least one said disk and on the shaft, and wherein the disk is also adhered on the shaft.

3. The fluid motor according to claim 2, wherein the exhaust cage has a cylindrical sleeve extending on one side with a partition forming a bottom wall of said cage, mounted in a fixed position on bearings, further comprising an exhaust grid connected and attached on a periphery of said sleeve.

4. The fluid motor according to claim 3, wherein the exhaust grid is fitted so as to receive an end of a fluid injection nozzle connected to a fluid supply pipe, with said nozzle communicating with the groove of the shaft.

5. The fluid motor according to claim 4, wherein an end of the motor shaft is conical and penetrates into an interior of the injection nozzle.

6. The fluid motor according to claim 1, further comprising a plurality of said exhaust cages each of which receives a disk.

* * * * *

UNITED STATES PATENT AND TRADEMARK OFFICE

CERTIFICATE OF CORRECTION

PATENT NO. : 5,118,250

DATED : June 2, 1992

INVENTOR(S) : Georges Sagnial and Jacques Chauquet

It is certified that error appears in the above-identified patent and that said Letters Patent is hereby corrected as shown below:

On the title page, item (76):

Inventor "Georges Sagnital" is misspelled and should read, instead, --Georges Sagnial--.

Signed and Sealed this

Ninth Day of November, 1993

*Attest:*

*Attesting Officer*

Bruce Lehman

BRUCE LEHMAN

*Commissioner of Patents and Trademarks*